United States Patent [19]

Dillarstone et al.

[11] 4,188,306

[45] Feb. 12, 1980

[54] PUMPABLE SOAP

[75] Inventors: Alan Dillarstone, Bramhall; Norman Lowe, Flixton; Edwin Cropper, Shaw, all of England

[73] Assignee: Colgate-Palmolive Company, New York, N.Y.

[21] Appl. No.: 825,802

[22] Filed: Aug. 18, 1977

[30] Foreign Application Priority Data

Aug. 23, 1976 [GB] United Kingdom ..... 34960/76

[51] Int. Cl.[2] ..... C11D 9/32; C11D 17/04

[52] U.S. Cl. ..... 252/121; 252/91; 252/DIG. 14

[58] Field of Search ..... 252/121, DIG. 14, 91

[56] References Cited

U.S. PATENT DOCUMENTS

| | | | |
|---|---|---|---|
| 3,203,900 | 8/1965 | Carroll et al. | 252/DIG. 14 |
| 3,707,503 | 12/1972 | Kenny | 252/DIG. 14 |
| 3,725,288 | 4/1973 | Bechtold | 252/91 |
| 4,065,398 | 12/1977 | Brouwer | 252/121 X |

*Primary Examiner*—Mayer Weinblatt

*Attorney, Agent, or Firm*—Richard N. Miller; Murray M. Grill; Herbert S. Sylvester

[57] ABSTRACT

An aqueous soap solution that is comprised predominantly of high tallow soap and an alkali metal or ammonium aryl sulfonate hydrotrope, which soap exhibits the ability of remaining as a pumpable single phase solution even at low temperatures.

5 Claims, No Drawings

PUMPABLE SOAP

This invention relates to aqueous soap solutions, more particularly to such soap solutions which can easily be rendered pumpable and to articles containing the same.

In accordance with the present invention, there is provided an aqueous soap solution which includes a high tallow sodium soap and an alkali metal or ammonium alkyl aryl sulfonate hydrotrope.

There are two main problems involved in handling sodium soap solutions when compared with their potassium equivalents: the viscosity of the former tends to be considerably higher, and the tendency of the former to separate, i.e., grain out from a single phase, is greater. These problems are increased by the use of soaps having a high tallow content, i.e., a high ratio of tallow to nut oil content.

These problems have frequently necessitated use of potassium and/or non-tallow soaps even where other factors, such as cost, mitigate against the use of those materials.

It has now been found that the soap solutions of the present invention can be maintained in a pumpable substantially single-phase condition at moderate temperatures, e.g., from about room temperature to about 70° C. despite the use of sodium and a high tallow content soap.

Acceptable viscosities for pumping soap solutions in this temperature range with typical soap industry equipment would be up to 1000 centipoises.

Soaps having such properties are expected to find use where, for example, diversity of manufacturing facilities of components of soap-containing products require transport of a soap solution or for a single-phase liquid soap product, e.g., a liquid hand soap. An example of the former type product is a soap-impregnated steel wool scouring pad. Where manufacturing conditions have necessitated manufacture of the soap solution remote from the site where the solution is impregnated into the steel wool pad, a "wet" sodium soap of non-tallow (high nut oil, e.g., coconut oil content) has been used. It is believed that the use of soaps of the present invention will offer significant advantages, not only in terms of the cost of raw materials, but also in allied manufacturing costs such as, for example, impregnation and drying costs, and further in that retention of the soap on the pad may be improved thereby improving the useful life of the product.

According to a further aspect of the present invention, a method of making a steel wool soap pad comprises conventionally impregnating a steel wool pad with a soap solution as defined above. The ratio of tallow to nut oils in this case may be about 100:1 to about 1:1, preferably about 9:1 to 4:1.

The impregnation may be achieved by injection of a quantity of the soap solution into a preformed steel wool pad, which operation may or may not be followed by an oven-drying step. Other conventionally known methods may also be employed if desired.

The term "high tallow soap" as used herein refers to a mixture of neutralized tallow and nut oil fatty acids in a range of proportions of about 100:1 to 1:1 by weight, preferably about 9:1 to 4:1.

Tallow fatty acids are usually obtained from the fat of cattle and sheep and a typical beef tallow contains, on a weight basis, about 3% of myristic acid, 29% palmitic acid, 18.5% stearic acid, 46.5% oleic acid and 3% linoleic acid. Nut oil fatty acids may be obtained from coconuts, palm kernel, babassu nuts and murumuru nuts. Typical fatty acid compositions of these nuts follow:

| Fatty Acid | Coconut | Palm Kernel | Bababassu | Murumuru |
|---|---|---|---|---|
| Caprylic | 8 | 3 | 6 | 1 |
| Capric | 7 | 7 | 3 | 2 |
| Lauric | 48 | 47 | 46 | 43 |
| Myristic | 17.5 | 14 | 20 | 37 |
| Palmitic | 9 | 9 | 7 | 4 |
| Stearic | 2 | 1 | — | 2 |
| Oleic | 6 | 18.5 | 18 | 11 |
| Linoleic | 2.5 | 0.5 | — | — |

The sodium tallow soap and the sodium nut oil soaps are obtained usually by neutralizing the particular fatty acids with an aqueous sodium hydroxide.

Alkali metal $C_1$–$C_4$ alkyl aryl sulfonates having hydrotrope or detergent properties are known. The compounds which are of use as hydrotropes in this invention are those having properties exemplified by hydrotropes such as those generically known as, for example, alkali metal toluene, i.e., the sodium or potassium salt thereof, xylene and cumene sulfonates.

The aqueous soap solution may comprise high tallow sodium soap and alkali metal or ammonium alkyl aryl sulfonate hydrotrope in a range of proportions of about 50:1 to 10:1 by weight, preferably about 25:1 to 10:1, e.g., 16:1, by weight.

The foregoing water-soluble sulfonate hydrotropes generally have about 1 to 4 carbon atoms, preferably about 1 to 2, in the alkyl group, while the aryl moiety will generally be an aromatic ring containing about 6 carbon atoms, namely, benzene. Further, the number of alkyl substituents on the benzene ring may be one, e.g. toluene, ethylbenzene and cumene sulfonate, or two, e.g., xylene sulfonate.

The soap solution if desired may also contain an alkali metal nitrite in an amount of about 0.2, for example, about 0 to 0.5%, preferably about 0.1 to 0.2% by weight. Representative species include sodium, potassium and lithium, with sodium nitrite being preferred.

The inclusion of nitrite in the soap solution may be of advantage owing to its corrosion inhibitory effect.

Such a soap solution comprising about 15 to 30%, preferably about 22 to 28% by weight, of a mixture of neutralized tallow fatty acids together with neutralized palm kernel oil/coconut oil fatty acids, about 1.0 to 2.0%, preferably about 1.5% by weight of sodium xylene sulfonate and about 0.1% to 0.5%, preferably about 0.2% by weight of sodium nitrite, the remainder comprising water, caustic soda and color and perfume and other additives, has been found to remain as a single-phase pumpable solution at a temperature as low as 45° C. A coloring material which transfers to the foam when diluted for use may be used. A higher proportion of the sulfonate hydrotrope reduces this temperature, for example, about 1:5, preferably about 1:8 relative to the soap.

The amount of water in the composition generally ranges from about 50 to 80% by weight, preferably about 65 to 75%. The caustic is present in neutralized amounts only.

Most conventional adjuvants may be present in the composition, for example, hand care ingredients, such as lanolin, proteins, etc.; foam stabilizers, e.g., alkanolamides; antimicrobial agents, e.g., bromosalicylanilides, hexachlorophene, trichlorocarbanilide; colors; perfumes; and deodorant ingredients; and are employed in conventional amounts, up to about 5% by weight, preferably about 0.1 to 2%.

This invention may be performed in various ways and some specific embodiments are described, by way of example, which are not to be considered as limiting the scope of the invention. All parts and proportions therein as well as in the following claims are by weight unless stated otherwise.

EXAMPLE 1

A soap solution is made containing the following:

| | % |
|---|---|
| Water | 62.0 |
| Caustic soda (36.1% $Na_2O$ solution) | 7.8 |
| Sodium xylene sulfonate (30% solution) | 5.0 |
| Tallow fatty acids | 22.5 |
| Distilled palm kernel oil | 2.5 |
| Sodium nitrite | 0.1 |
| Color/dye/perfume | q.s. |
| | 100.0 |

The fatty acids are mixed together and heated to 70° C. The water, caustic soda, nitrite and hydrotrope are mixed and heated to 70° C.

The fatty acid mixture is then added slowly to the sulfonate hydrotrope/caustic solution.

The solution will remain stable as a single phase at moderate temperatures and has a viscosity at 65° C. of 300–600 cps (Brookfield RVT test).

EXAMPLE 2

Example 1 is repeated except that coconut oil fatty acid is substituted for palm kernel oil fatty acids.

EXAMPLE 3

Example 1 is repeated except that a combination of palm kernel oil and coconut oil fatty acids is substituted for palm kernel oil fatty acid.

EXAMPLE 4

Example I is repeated except that cumene sulfonate is employed.

EXAMPLE 5

Example 1 is repeated except that the color, dye and perfume are omitted and water is employed as a replacement therefor.

EXAMPLE 6

Example 1 is repeated except that the ratio of fatty acids is 85:15 (tallow:coconut oil).

EXAMPLE 7

Example 1 is repeated except that an 80:20 mixture of tallow:coconut oil fatty acids is substituted for that of Example 1.

EXAMPLE 8

A soap pad is made by injection of the soap solution of Example 1 into a preformed steel wool pad. A blue coloring (e.g., Erio Brilliant Blue V-150%) is used in an amount of about 0.05%. This coloring transfers to the foam in use to give a pleasing effect. The solution readily "skins" on exposure to air so an oven drying step may not be needed.

The pad so produced is found to function and last well in use.

What is claimed is:

1. An aqueous soap composition which is pumpable and substantially single phase at a temperature in the range of about room temperature to about 70° C. and consists essentially of, by weight, about 15% to 30% of a sodium soap obtained by neutralizing a mixture of tallow fatty acids and nut oil $C_8$–$C_{18}$ fatty acids with an aqueous sodium hydroxide, the weight ratio of tallow fatty acids to nut oil fatty acids being in the range of 100:1 to 1:1; a water-soluble sodium, potassium or ammonium salt of a $C_1$–$C_4$ alkylbenzene sulfonate, the weight ratio of said soap to said sulfonate being about 50:1 to 10:1 and being sufficient to maintain the viscosity of said composition in a pumpable range; and 50% to 80% of water.

2. A steel wool soap pad consisting essentially of a preformed steel wool pad impregnated with the soap composition of claim 1.

3. A composition as defined in claim 1 wherein the weight ratio of said soap to said sulfonate is about 25:1 to 10:1.

4. A composition as defined in claim 3 which contains, in addition, about 0.1% to 0.5% by weight of an alkali metal nitrite.

5. A steel wool soap paid consisting essentially of a preformed steel wool pad impregnated with the soap composition of claim 4.

* * * * *